US012538939B2

(12) United States Patent
Bailey et al.

(10) Patent No.: US 12,538,939 B2
(45) Date of Patent: Feb. 3, 2026

(54) AEROSOL-GENERATING MATERIAL COMPRISING AN AMORPHOUS SOLID WITH CARRAGEENAN

(71) Applicant: Nicoventures Trading Limited, London (GB)

(72) Inventors: Chelsea Bailey, London (GB); Molly Thacker, London (GB)

(73) Assignee: NICOVENTURES TRADING LIMITED, London (GB)

( * ) Notice: Subject to any disclaimer, the term of this patent is extended or adjusted under 35 U.S.C. 154(b) by 338 days.

(21) Appl. No.: 17/756,511

(22) PCT Filed: Nov. 27, 2020

(86) PCT No.: PCT/EP2020/083748
§ 371 (c)(1),
(2) Date: May 26, 2022

(87) PCT Pub. No.: WO2021/105437
PCT Pub. Date: Jun. 3, 2021

(65) Prior Publication Data

US 2023/0000134 A1 Jan. 5, 2023

(30) Foreign Application Priority Data

Nov. 29, 2019 (GB) ..... 1917470

(51) Int. Cl.

| | |
|---|---|
| ***A24B 15/28*** | (2006.01) |
| ***A24B 15/167*** | (2020.01) |
| ***A24B 15/30*** | (2006.01) |
| ***A24C 5/01*** | (2020.01) |
| ***A24D 1/20*** | (2020.01) |
| ***A24F 40/20*** | (2020.01) |

(52) U.S. Cl.
CPC ..... *A24B 15/283* (2013.01); *A24B 15/167* (2016.11); *A24B 15/301* (2013.01); *A24B 15/303* (2013.01); *A24C 5/01* (2020.01); *A24D 1/20* (2020.01); *A24F 40/20* (2020.01)

(58) Field of Classification Search
CPC ... A24B 15/167; A24B 15/283; A24B 15/301; A24B 15/303; A24C 5/01; A24D 1/20; A24F 40/20
See application file for complete search history.

(56) References Cited

U.S. PATENT DOCUMENTS

| | | | | |
|---|---|---|---|---|
| 5,502,179 | A * | 3/1996 | Larsen | C08B 37/0042 536/123 |
| 10,010,110 | B2 | 7/2018 | Metrangolo et al. | |
| 2013/0327346 | A1* | 12/2013 | Tanaka | B05D 3/02 131/360 |
| 2015/0209530 | A1 | 7/2015 | White | |
| 2016/0120224 | A1 | 5/2016 | Mishra et al. | |
| 2016/0120225 | A1 | 5/2016 | Mishra et al. | |
| 2017/0340005 | A1* | 11/2017 | Terao | A24F 47/00 |
| 2018/0235273 | A1 | 8/2018 | Carroll et al. | |
| 2018/0352862 | A1 | 12/2018 | Mironov et al. | |
| 2019/0142058 | A1 | 5/2019 | Klipfel et al. | |
| 2021/0015746 | A1* | 1/2021 | Capelli | A24B 15/32 |

FOREIGN PATENT DOCUMENTS

| | | | | |
|---|---|---|---|---|
| CA | 2473312 | A1 | 7/2003 | |
| CN | 103960784 | A | 8/2014 | |
| EP | 0545186 | A2 | 6/1993 | |
| JP | S51/048500 | A | 4/1976 | |
| JP | S51/128500 | A | 11/1976 | |
| JP | H05153946 | A | 6/1993 | |
| JP | 2016/189700 | A | 11/2016 | |
| JP | 2018/057386 | A | 6/2018 | |
| JP | 2019/519209 | A | 7/2019 | |
| JP | 2019/141013 | A | 8/2019 | |
| JP | 2019/526232 | A | 9/2019 | |
| RU | 2621661 | C1 | 6/2017 | |
| WO | WO 2015/062983 | | 5/2015 | |
| WO | WO 2016/135331 | | 9/2016 | |
| WO | 2018/019578 | A1 | 2/2018 | |
| WO | 2018/100688 | A1 | 6/2018 | |
| WO | 2018/122096 | A1 | 7/2018 | |
| WO | 2019/101946 | A1 | 5/2019 | |
| WO | WO-2019166640 | A1 | 9/2019 | |
| WO | 2019/193210 | A1 | 10/2019 | |
| WO | WO-2019193209 | A1 * | 10/2019 | A24B 15/167 |

OTHER PUBLICATIONS

International Search Report and Written Opinion for Application No. PCT/EP2020/083748, mailed on Mar. 1, 2021, 11 pages.

* cited by examiner

*Primary Examiner* — Michael H. Wilson
*Assistant Examiner* — Adam Z Baratz
(74) *Attorney, Agent, or Firm* — WOMBLE BOND DICKINSON (US) LLP

(57) ABSTRACT

A substrate is provided comprising an aerosol-generating material, the aerosol-generating material comprising a thermoreversible amorphous solid, the thermoreversible amorphous solid comprising: 0.5-20 wt % of iota- and/or kappa-carrageenan; 20-80 wt % of an aerosol-former material; 20-70 wt % of a flavorant and/or an active substance; wherein these weights are calculated on a dry weight basis. Consumables and non-combustible aerosol provision systems comprising the substrate, as well as methods of making and using these, are also provided.

21 Claims, 5 Drawing Sheets

AEROSOL-GENERATING MATERIAL COMPRISING AN AMORPHOUS SOLID WITH CARRAGEENAN

PRIORITY CLAIM

The present application is a National Phase entry of PCT Application No. PCT/EP2020/083748, filed Nov. 27, 2020, which claims priority to Great Britain Application No. 1917470.5, filed Nov. 29, 2019, each of which is hereby fully incorporated herein by reference.

TECHNICAL FIELD

The present disclosure relates to substrates comprising an aerosol-generating material, the aerosol-generating material comprising a thermoreversible amorphous solid; consumables comprising said substrate; and non-combustible aerosol provision systems comprising the consumables.

BACKGROUND

Smoking consumables such as cigarettes, cigars and the like burn tobacco during use to create tobacco smoke. Alternatives to these types of consumables release an inhalable aerosol or vapor by releasing compounds from a substrate material by heating without burning. These may be referred to as non-combustible smoking consumables or aerosol generating assemblies.

One example of such a product is a heating device which releases compounds by heating, but not burning, a solid aerosol-generating material. This solid aerosol-generating material may, in some cases, contain a tobacco material. The heating volatilizes at least one component of the material, typically forming an inhalable aerosol. These products may be referred to as heat-not-burn devices, tobacco heating devices or tobacco heating products. Various different arrangements for volatilizing at least one component of the solid aerosol-generating material are known.

As another example, there are hybrid devices. These hybrid devices contain a liquid source (which may or may not contain nicotine) which is vaporized by heating to produce an inhalable vapor or aerosol. The device additionally contains a solid aerosol-generating material (which may or may not contain a tobacco material) and components of this material are entrained in the inhalable vapor or aerosol to produce the inhaled medium.

SUMMARY

According to a first aspect, there is provided a substrate comprising an aerosol-generating material, the aerosol-generating material comprising a thermoreversible amorphous solid, the thermoreversible amorphous solid comprising:

0.5-20 wt % of iota- and/or kappa-carrageenan;

20-80 wt % of an aerosol-former material;

20-70 wt % of a flavorant and/or an active substance;

wherein these weights are calculated on a dry weight basis.

There is also provided a consumable for use in a non-combustible aerosol provision system, the consumable comprising the substrate as described above.

There is also provided a non-combustible aerosol provision system comprising the consumable described above and a non-combustible aerosol provision device, the non-combustible aerosol provision device comprising an aerosol-generation device to generate aerosol from the substrate of the consumable when the consumable is used with the non-combustible aerosol provision device.

There is also provided a method of manufacturing an aerosol-generating material, the method comprising:

(a) dissolving iota- and/or kappa-carrageenan in water to form an aqueous solution;

(b) supplying a setting agent to the aqueous solution; and (c) adding aerosol-former material, flavorant and/or active substance to the aqueous solution to form a slurry (d) shaping the slurry; and (e) drying the slurry to form an amorphous solid.

Use of the substrate described herein to generate an aerosol is also contemplated. A non-combustible aerosol provision device comprising an aerosol-generation device can be used to generate aerosol from the substrate of the consumable when the consumable is used with the non-combustible aerosol provision device.

Further features and advantages will become apparent from the following description of various embodiments, given by way of example only, which is made with reference to the accompanying drawings.

BRIEF DESCRIPTION OF THE DRAWINGS

FIG. 6 shows a section view of an example of a non-combustible aerosol provision system.

DETAILED DESCRIPTION

Figure 1:
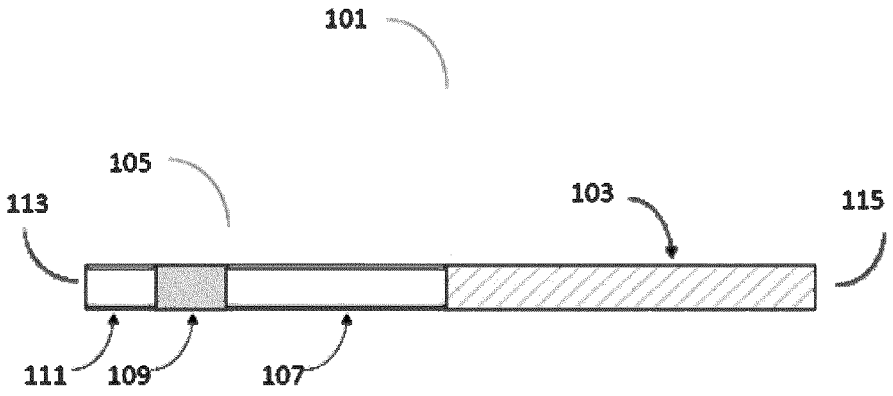
FIG. 1 shows a section view of an example of a consumable.

As noted above, there is provided a substrate comprising an aerosol-generating material, the material comprising a thermoreversible amorphous solid, the thermoreversible amorphous solid comprising:

0.5-20 wt % of iota- and/or kappa-carrageenan;

20-80 wt % of an aerosol-former material;

20-70 wt % of a flavorant and/or an active substance;

wherein these weights are calculated on a dry weight basis.

A consumable comprising a substrate comprising an aerosol-generating material is also provided and comprises a thermoreversible amorphous solid, the thermoreversible amorphous solid comprising:

0.5-20 wt % of iota- and/or kappa-carrageenan;

20-80 wt % of aerosol-former material;

20-70 wt % of a flavorant and/or an active substance;

wherein these weights are calculated on a dry weight basis.

Carrageenan is a mixture of polysaccharides which can be extracted from red and purple seaweeds. Most commonly it is used as a thickening or emulsifying agent in food products, such as nut milks, meat products, and yogurt. There are three main types of carrageenan—iota-carrageenan, kappa-carrageenan and lambda-carrageenan. Kappa and iota-carrageenan are used as a gelling agents; however, lambda-carrageenan is used as a thickener. Kappa- and iota-carrageenan form gels (amorphous solids) in the presence of ions, such as calcium and/or potassium ions.

Amorphous solids formed from carrageenan may be solid at room temperature (for example, at temperatures less than about 30° C.), but liquid upon heating (for example, at temperatures greater than about 30° C.). Advantageously, this property may be exploited in amorphous solid-based consumables for electronic smoking devices, since the amorphous solid is solid at room temperature and so does not leak aerosol-generating material during storage or transport. Upon heating, the amorphous solid melts and become liquid, releasing active and/or aromatic compounds contained therein. The inventors have found that as the amorphous solid sets, flavour compounds are stabilized within the amorphous solid matrix allowing a higher flavorant loading to be achieved than in non-amorphous solid compositions. The flavorant (e.g. menthol) is stabilized at high concentrations and the products have a good shelf life.

In some embodiments the thermoreversible amorphous solid is liquid when heated in a non-combustible aerosol delivery device to a temperature greater than about 30° C., for example, greater than about 35° C., 40° C., 45° C., 50° C., 55° C., 60° C., 65° C., 70° C., 80° C., 90° C. or 100° C. Advantageously, the temperature at which the thermoreversible amorphous solid becomes liquid can be adjusted by optimizing the quantity of carrageenan added to the thermoreversible amorphous solid. Hence, if it is desired that the thermoreversible amorphous solid becomes liquid at a lower temperature, then the quantity of carrageenan may be reduced until the desired melting temperature is achieved. Conversely, if it is desired that the thermoreversible amorphous solid remains solid until exposed to higher temperatures then this may be achieved by increasing the quantity of carrageenan in the thermoreversible amorphous solid.

In some embodiments the aerosol-generating material is liquid when heated in a non-combustible aerosol delivery device to a temperature greater than about 30° C., for example, greater than about 35° C., 40° C., 45° C., 50° C., 55° C., 60° C., 65° C., 70° C., 80° C., 90° C. or 100° C. Advantageously, the temperature at which the aerosol-generating material becomes liquid can be adjusted by optimizing the quantity of carrageenan added to the aerosol-generating material. Hence, if it is desired that the aerosol-generating material becomes liquid at a lower temperature, then the quantity of carrageenan may be reduced until the desired melting temperature is achieved. Conversely, if it is desired that the aerosol-generating material remains solid until exposed to higher temperatures then this may be achieved by increasing the quantity of carrageenan in the aerosol generating material.

In some embodiments the thermoreversible amorphous solid is solid before it is heated in a non-combustible aerosol delivery device to a temperature greater than about 30° C., for example, the thermoreversible amorphous solid is solid at temperatures lower than about 30° C.; for example, lower than about 25° C., 20° C. or 15° C.

In some embodiments the aerosol-generating material is solid before it is heated in a non-combustible aerosol delivery device to a temperature greater than about 30° C., for example, the aerosol-generating material is solid at temperatures lower than about 30° C.; for example, lower than about 25° C., 20° C. or 15° C.

In some cases the thermoreversible amorphous solid comprises iota- and/or kappa-carrageenan in an amount from about 2 wt % to about 20 wt %, or about 3 wt % to about 15 wt %, or about 4 wt % to about 10 wt %, or about 2 wt % to about 5 wt % (all calculated on a dry weight basis); In some cases the thermoreversible amorphous solid comprises kappa-carrageenan in an amount from about 2 wt % to about 5 wt %, calculated on a dry weight basis.

Suitably, the thermoreversible amorphous solid may comprise from about 20 wt % to about 50 wt %, 45 wt %, 40 wt %, 35 wt %, 30 wt % or 25 wt % of an aerosol-former material (all calculated on a dry weight basis). The aerosol-former material may act as a plasticizer. For example, the thermoreversible amorphous solid may comprise 20-40 wt %, 20-35 wt % or 20-25 wt % of an aerosol-former material. In some cases, the aerosol-former material comprises one or more compounds selected from erythritol, propylene glycol, glycerol, triacetin, sorbitol and xylitol. In some cases, the aerosol-former material comprises, consists essentially of or consists of glycerol. The inventors have established that if the content of the plasticizer is too high, the thermoreversible amorphous solid may absorb water resulting in a material that does not create an appropriate consumption experience in use. The inventors have established that if the plasticizer content is too low, the thermoreversible amorphous solid may be brittle and easily broken. The plasticizer content specified herein provides the thermoreversible amorphous solid with flexibility which allows a sheet of the thermoreversible amorphous solid to be wound onto a bobbin, which is useful in manufacture of certain aerosol generating consumables.

In some embodiments, the aerosol-former material comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

In some cases, the thermoreversible amorphous solid may additionally comprise an emulsifying agent, which emulsifies molten flavorant during manufacture. For example, the thermoreversible amorphous solid may comprise from about 5 wt % to about 15 wt % of an emulsifying agent (calculated on a dry weight basis), suitably about 10 wt %. The emulsifying agent may comprise acacia gum.

In some embodiments, the thermoreversible amorphous solid is a hydrogel and comprises less than about 20 wt % of water calculated on a wet weight basis. In some cases, the hydrogel may comprise less than about 15 wt %, 12 wt % or 10 wt % of water calculated on a wet weight basis. In some cases, the hydrogel may comprise at least about 1 wt %, 2 wt % or at least about 5 wt % of water (WWB).

In some embodiments, the thermoreversible amorphous solid comprises flavorant. Suitably, the thermoreversible amorphous solid may comprise up to about 70 wt %, 60 wt %, 55 wt %, 50 wt % or 45 wt % of a flavorant. In some cases, the thermoreversible amorphous solid may comprise at least about 0.1 wt %, 1 wt %, 10 wt %, 20 wt %, 30 wt %, 35 wt % or 40 wt % of a flavorant (all calculated on a dry weight basis). For example, the thermoreversible amorphous solid may comprise 1-70 wt %, 10-70 wt %, 20-70 wt %, 30-60 wt %, 35-55 wt % or 30-45 wt % of a flavorant. In some cases, the flavorant comprises, consists essentially of or consists of menthol.

In some embodiments, the thermoreversible amorphous solid comprises an active substance. In some cases the active substance comprises a tobacco material and/or nicotine. In some embodiments, the amorphous solid comprises powdered tobacco and/or nicotine and/or a tobacco extract.

In embodiments where the thermoreversible amorphous solid comprises an active substance, in some cases, the thermoreversible amorphous solid comprises a botanical material and/or nicotine. In some cases, the thermoreversible amorphous solid comprises 5-60 wt % (calculated on a dry weight basis) of a botanical material and/or nicotine. In some cases, the botanical material is tobacco, and in such cases the thermoreversible amorphous solid comprises 5-60 wt % of tobacco and/or nicotine. In some cases, the thermoreversible amorphous solid may comprise from about 1 wt %, 5 wt %, 10 wt %, 15 wt %, 20 wt % or 25 wt % to about 70 wt %, 60 wt %, 50 wt %, 45 wt %, 40 wt %, 35 wt %, or 30 wt % (calculated on a dry weight basis) of an active substance. In some cases, the thermoreversible amorphous solid may comprise from about 1 wt %, 5 wt %, 10 wt %, 15 wt %, 20 wt % or 25 wt % to about 70 wt %, 60 wt %, 50 wt %, 45 wt %, 40 wt %, 35 wt %, or 30 wt % (calculated on a dry weight basis) of a botanical material. For example, the thermoreversible amorphous solid may comprise 10-50 wt %, 15-40 wt % or 20-35 wt % of a botanical material; in some of these embodiments the botanical material is tobacco. In some cases, the thermoreversible amorphous solid may comprise from about 1 wt %, 2 wt %, 3 wt % or 4 wt % to about 20 wt %, 18 wt %, 15 wt % or 12 wt % (calculated on a dry weight basis) of nicotine. For example, the thermoreversible amorphous solid may comprise 1-20 wt %, 2-18 wt % or 3-12 wt % of nicotine.

In some cases, the thermoreversible amorphous solid comprises an active substance such as tobacco extract. In some cases, the thermoreversible amorphous solid comprises 5-60 wt % (calculated on a dry weight basis) of tobacco extract. In some cases, the thermoreversible amorphous solid comprises from about 5 wt %, 10 wt %, 15 wt %, 20 wt % or 25 wt % to about 60 wt %, 50 wt %, 45 wt %, 40 wt %, 35 wt %, or 30 wt % (calculated on a dry weight basis) tobacco extract. For example, the thermoreversible amorphous solid comprises 10-50 wt %, 15-40 wt % or 20-35 wt % of tobacco extract. The tobacco extract may contain nicotine at a concentration such that the thermoreversible amorphous solid comprises 1 wt % 1.5 wt %, 2 wt % or 2.5 wt % to about 6 wt %, 5 wt %, 4.5 wt % or 4 wt % (calculated on a dry weight basis) of nicotine. In some cases, there may be no nicotine in the thermoreversible amorphous solid other than that which results from the tobacco extract.

In some embodiments, the thermoreversible amorphous solid comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT).

The thermoreversible amorphous solid may comprise one or more cannabinoid compounds selected from the group consisting of cannabidiol (CBD) and THC (tetrahydrocannabinol).

The thermoreversible amorphous solid may comprise cannabidiol (CBD).

The thermoreversible amorphous solid may comprise nicotine and cannabidiol (CBD).

The thermoreversible amorphous solid may comprise nicotine, cannabidiol (CBD), and THC (tetrahydrocannabinol).

In some embodiments the thermoreversible amorphous solid comprises no tobacco material but does comprise nicotine. In some such cases, the thermoreversible amorphous solid may comprise from about 1 wt %, 2 wt %, 3 wt % or 4 wt % to about 20 wt %, 18 wt %, 15 wt % or 12 wt % (calculated on a dry weight basis) of nicotine. For example, the thermoreversible amorphous solid may comprise 1-20 wt %, 2-18 wt % or 3-12 wt % of nicotine.

In some cases, the total content of active substance and/or flavorant may be at least about 20 wt %, 25 wt % or 30 wt %. In some cases, the total content of active substance and/or flavorant may be less than about 70 wt %, 60 wt %, 50 wt % or 40 wt % (all calculated on a dry weight basis).

In some cases, the total content of tobacco material, nicotine and flavorant may be at least about 1 wt %, 5 wt %, 10 wt %, 20 wt %, 25 wt %, 30 wt %, 40 wt %, or 50 wt %.

The aerosol-generating material or thermoreversible amorphous solid may comprise an acid. The acid may be an organic acid. In some of these embodiments, the acid may be at least one of a monoprotic acid, a diprotic acid and a triprotic acid. In some such embodiments, the acid may contain at least one carboxyl functional group. In some such embodiments, the acid may be at least one of an alpha-hydroxy acid, carboxylic acid, dicarboxylic acid, tricarboxylic acid and keto acid. In some such embodiments, the acid may be an alpha-keto acid.

In some such embodiments, the acid may be at least one of succinic acid, lactic acid, benzoic acid, citric acid, tartaric acid, fumaric acid, levulinic acid, acetic acid, malic acid, formic acid, sorbic acid, benzoic acid, propanoic and pyruvic acid.

Suitably the acid is lactic acid. In other embodiments, the acid is benzoic acid. In other embodiments the acid may be an inorganic acid. In some of these embodiments the acid may be a mineral acid. In some such embodiments, the acid may be at least one of sulphuric acid, hydrochloric acid, boric acid and phosphoric acid. In some embodiments, the acid is levulinic acid.

The inclusion of an acid is particularly preferred in embodiments in which the aerosol-generating material or thermoreversible amorphous solid comprises nicotine. In such embodiments, the presence of an acid may stabilize dissolved species in the slurry from which the aerosol-generating material or thermoreversible amorphous solid is formed. The presence of the acid may reduce or substantially prevent evaporation of nicotine during drying of the slurry, thereby reducing loss of nicotine during manufacturing.

In some embodiments, aerosol-generating material or thermoreversible amorphous solid further comprises a gelling agent other than kappa and/or iota-carrageenan. In some embodiments, this additional gelling agent is a hydrocolloid. In some embodiments, the additional gelling agent comprises one or more compounds selected from the group comprising starches (and derivatives), celluloses (and derivatives, such as such as methylcellulose, hydroxypropyl cellulose, and carboxymethyl cellulose (CMC)), gums, silica or silicones compounds, clays, polyvinyl alcohol and combinations thereof. For example, in some embodiments, the additional gelling agent comprises one or more of hydroxyethyl cellulose, hydroxypropyl cellulose, carboxymethylcellulose, pullulan, xanthan gum, guar gum, agarose, acacia gum, fumed silica, PDMS, sodium silicate, kaolin and polyvinyl alcohol.

The additional gelling agent may comprise one or more compounds selected from cellulosic gelling agents, non-cellulosic gelling agents, guar gum, acacia gum and mixtures thereof.

In some embodiments, the cellulosic gelling agent is selected from the group consisting of: hydroxymethyl cellulose, hydroxyethyl cellulose, hydroxypropyl cellulose, carboxymethylcellulose (CMC), hydroxypropyl methylcellulose (HPMC), methyl cellulose, ethyl cellulose, cellulose acetate (CA), cellulose acetate butyrate (CAB), cellulose acetate propionate (CAP) and combinations thereof.

In some embodiments, the additional gelling agent comprises one or more of hydroxyethyl cellulose, hydroxypropyl cellulose, hydroxypropyl methylcellulose (HPMC), carboxymethylcellulose, guar gum, or acacia gum.

In some embodiments, the additional gelling agent comprises one or more non-cellulosic gelling agents, including, but not limited to, agar, xanthan gum, gum Arabic, guar gum, locust bean gum, starch, and combinations thereof. In preferred embodiments, the non-cellulose based gelling agent further comprises agar.

In certain embodiments, the aerosol-generating material or thermoreversible amorphous solid comprises a gelling agent comprising a cellulosic gelling agent and/or a non-cellulosic gelling agent, an active substance and an acid.

In some embodiments the thermoreversible amorphous solid comprises the following compositions (all calculated on a dry weight basis); iota- and/or kappa-carrageenan in an amount from about 2 wt % to about 20 wt %, or about 3 wt % to about 15 wt %, or about 4 wt % to about 10 wt %, or about 2 wt % to about 5 wt %; an aerosol-former material in an amount of from about 20 wt % to about 70 wt %, or from about 20 wt % to about 60 wt %, or from about 25 wt % to about 50 wt %, or from about 30 wt % to about 45 wt % (all calculated on a dry weight basis); flavorant and/or an active substance in an amount of from about 30 wt % to about 60 wt %, or from about 40 wt % to 55 wt %, or from about 45 wt % to about 50 wt %.

In some cases the thermoreversible amorphous solid comprises the following compositions (all calculated on a dry weight basis); kappa-carrageenan in an amount from about 2 wt % to about 20 wt %, or about 3 wt % to about 15 wt %, or about 4 wt % to about 10 wt %, or about 2 wt % to about 5 wt %; glycerol in an amount of from about 20 wt % to about 70 wt %, or from about 20 wt % to about 60 wt %, or from about 25 wt % to about 50 wt %, or from about 30 wt % to about 45 wt % (all calculated on a dry weight basis); nicotine in an amount of from about 1 wt % to about 10 wt %, or from about 1 wt % to 10 wt %, or from about 1 wt % to about 5 wt %; flavorant and/or tobacco extract in an amount of from about 30 wt % to about 60 wt %, or from about 40 wt % to 55 wt %, or from about 45 wt % to about 50 wt %.

In some cases the thermoreversible amorphous solid comprises the following composition (all calculated on a dry weight basis); kappa-carrageenan in an amount from about 2 wt % to about 5 wt %; glycerol in an amount from about 30 wt % to about 45 wt %; nicotine in an amount of from about 1 wt % to about 5 wt %; flavorant and/or tobacco extract in an amount of from about 40 wt % to 55 wt %.

In some cases the thermoreversible amorphous solid comprises the following composition (all calculated on a dry weight basis); kappa-carrageenan in an amount from about 2 wt % to about 5 wt %; glycerol in an amount from about 30 wt % to about 45 wt %; nicotine in an amount of from about 1 wt % to about 5 wt %; flavorant and/or tobacco extract in an amount of from about 40 wt % to 55 wt %; setting agent (calcium source) in an amount from about 0.1 wt % to about 2 wt %; an acid, in an amount from about 0.5 wt % to about 5 wt %.

The inventors have found that including locust bean gum in the thermoreversible amorphous solid of the aerosol-generating material provides additional strength to the thermoreversible amorphous solid and reduces its elasticity. Hence, in certain embodiments the thermoreversible amorphous solid further comprises locust bean gum. Suitably, the thermoreversible amorphous solid in such embodiments comprises from 0.1 wt %-5 wt % locust bean gum wherein the weight is calculated on a dry weight basis; for example, the thermoreversible amorphous solid comprises 0.1 wt %-1.0 wt %, or 1-2 wt %, or 2-5 wt % locust bean gum wherein the weight is calculated on a dry weight basis.

In some embodiments, the thermoreversible amorphous solid comprises a setting agent. Suitably the setting agent is a source of calcium; for example, calcium lactate or calcium citrate. The total amount of the setting agent, such as a calcium source, may be 0.5-5 wt % (calculated on a dry weight basis), for example 1-3 wt % or 2-4 wt %. Suitably, the total amount may be from about 1 wt %, 2.5 wt % or 4 wt % to about 4.8 wt % or 4.5 wt %. The inventors have found that the addition of too little setting agent may result in an thermoreversible amorphous solid which does not stabilize the flavorant and results in the flavor dropping out of the thermoreversible amorphous solid. The inventors have found that the addition of too much setting agent results in a thermoreversibleamorphous solid that is very tacky and consequently has poor handleability.

When the thermoreversible amorphous solid does not contain tobacco, a higher amount of setting agent may need to be applied. In some cases the total amount of setting agent may therefore be from 0.5-12 wt % such as 5-10 wt %, calculated on a dry weight basis. Suitably, the total amount may be from about 5 wt %, 6 wt % or 7 wt % to about 12 wt % or 10 wt %. In this case the thermoreversible amorphous solid will not generally contain any tobacco.

In examples, the setting agent comprises or consists of calcium acetate, calcium formate, calcium carbonate, calcium hydrogencarbonate, calcium chloride, calcium lactate, or a combination thereof. In some examples, the setting agent comprises or consists of calcium formate and/or calcium lactate. In particular examples, the setting agent comprises or consists of calcium formate. The inventors have identified that, typically, employing calcium formate as a setting agent results in a thermoreversible amorphous solid having a greater tensile strength and greater resistance to elongation.

The thermoreversible amorphous solid may comprise a colorant. The addition of a colorant may alter the visual appearance of the thermoreversible amorphous solid. The presence of colorant in the thermoreversible amorphous solid may enhance the visual appearance of the thermoreversible amorphous solid and the aerosol-generating material. By adding a colorant to the thermoreversible amorphous solid, the thermoreversible amorphous solid may be color-matched to other components of the aerosol-generating material or to other components of an article comprising the thermoreversible amorphous solid.

A variety of colorants may be used depending on the desired color of the thermoreversible amorphous solid. The color of thermoreversible amorphous solid may be, for example, white, green, red, purple, blue, brown or black. Other colors are also envisaged. Natural or synthetic colorants, such as natural or synthetic dyes, food-grade colorants and pharmaceutical-grade colorants may be used. In certain embodiments, the colorant is caramel, which may confer the thermoreversible amorphous solid with a brown appearance. In such embodiments, the color of the thermoreversible amorphous solid may be similar to the color of other components (such as tobacco material) in an aerosol-generating material comprising the thermoreversible amorphous solid. In some embodiments, the addition of a colorant to the thermoreversible amorphous solid renders it visually indistinguishable from other components in the aerosol-generating material.

The colorant may be incorporated during the formation of the thermoreversible amorphous solid (e.g. when forming a slurry comprising the materials that form the thermoreversible amorphous solid) or it may be applied to the thermoreversible amorphous solid after its formation (e.g. by spraying it onto the thermoreversible amorphous solid).

In some embodiments, the thermoreversible amorphous solid comprises less than 60 wt % of a filler, such as from 1 wt % to 60 wt %, or 5 wt % to 50 wt %, or 5 wt % to 30 wt %, or 10 wt % to 20 wt %.

In other embodiments, the thermoreversible amorphous solid comprises less than 20 wt %, suitably less than 10 wt % or less than 5 wt % of a filler. In some cases, the thermoreversible amorphous solid comprises less than 1 wt % of a filler, and in some cases, comprises no filler.

In some cases, the thermoreversible amorphous solid comprises from 1-60 wt % of a filler, for example, 5-50 wt %, 10-40 wt % or 15-30 wt % of a filler. In some such cases the thermoreversible amorphous solid comprises at least 1 wt % of a filler, for example, at least 5 wt %, at least 10 wt %, at least 20 wt % at least 30 wt %, at least 40 wt %, or at least 50 wt % of a filler The filler, if present, may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives (such as methylcellulose, hydroxypropyl cellulose, and carboxymethyl cellulose (CMC)). In particular cases, the thermoreversible amorphous solid comprises no calcium carbonate such as chalk.

In particular embodiments which include filler, the filler is fibrous. For example, the filler may be a fibrous organic filler material such as wood pulp, hemp fiber, cellulose or cellulose derivatives (such as methylcellulose, hydroxypropyl cellulose, and carboxymethyl cellulose (CMC)). Without wishing to be bound by theory, it is believed that including fibrous filler in a thermoreversible amorphous solid may increase the tensile strength of the material. This may be particularly advantageous in examples wherein the thermoreversible amorphous solid is provided as a sheet, such as when a thermoreversible amorphous solid sheet circumscribes a rod of aerosol-generating material.

In some embodiments, the thermoreversible amorphous solid does not comprise tobacco fibers. In particular embodiments, the thermoreversible amorphous solid does not comprise fibrous material.

In some embodiments, the aerosol-generating material does not comprise tobacco fibers. In particular embodiments, the aerosol-generating material does not comprise fibrous material.

In some embodiments, the substrate does not comprise tobacco fibers. In particular embodiments, the substrate does not comprise fibrous material.

In some embodiments, the consumable does not comprise tobacco fibers. In particular embodiments, the consumable does not comprise fibrous material.

In some embodiments the aerosol-generating material substantially consists of or consists of the thermoreversible amorphous solid described herein.

In some embodiments the substrate substantially consists of or consists of the aerosol-generating material described herein.

In some embodiments the substrate substantially consists of or consists of the thermoreversible amorphous solid described herein.

The substrate may comprise a support on which the aerosol-generating material is provided. The support functions as a support on which an aerosol-generating material layer forms, easing manufacture. The support may provide tensile strength to the aerosol-generating material, easing handling.

In some cases, the support may be formed from materials selected from metal foil, paper, carbon paper, greaseproof paper, ceramic, carbon allotropes such as graphite and graphene, plastic, cardboard, wood or combinations thereof. In some cases, the support may comprise or consist of a tobacco material, such as a sheet of reconstituted tobacco. In some cases, the support may be formed from materials selected from metal foil, paper, cardboard, wood or combinations thereof. In some cases, the support itself be a laminate structure comprising layers of materials selected from the preceding lists. In some cases, the support may also function as a flavorant carrier. For example, the support may be impregnated with a flavorant or with tobacco extract.

In some cases, the support may be non-magnetic.

In some cases, the support may be magnetic. This functionality may be used to fasten the support to a non-combustible aerosol-provision device in use or may be used to generate particular thermoreversible amorphous solid shapes. In some cases, the substrate or aerosol-generating material may comprise one or more magnets which can be used to fasten the substrate or aerosol-generating material to an induction heater in use.

In some cases, the support may be substantially or wholly impermeable to gas and/or aerosol. This prevents aerosol or gas passage through the support, thereby controlling the flow and ensuring it is delivered to the user. This can also be used to prevent condensation or other deposition of the gas/aerosol in use on, for example, the surface of a heater provided in an aerosol-generating assembly. Thus, consumption efficiency and hygiene can be improved in some cases.

In some cases, the surface of the support that abuts the thermoreversible amorphous solid may be porous. For example, in one case, the support comprises paper. The inventors have found that a porous support such as paper is particularly suitable; the porous (e.g. paper) layer abuts the aerosol-generating material layer and forms a strong bond. The aerosol-generating material is formed by drying a thermoreversible amorphous solid and, without being limited by theory, it is thought that the slurry from which the thermoreversible amorphous solid is formed partially impregnates the porous support (e.g. paper) so that when the thermoreversible amorphous solid sets and forms cross-links, the support is partially bound into the thermoreversible amorphous solid. This provides a strong binding between the thermoreversible amorphous solid and the support (and between the dried thermoreversible amorphous solid and the support).

Additionally, surface roughness may contribute to the strength of bond between the aerosol-generating material and the support. The inventors have found that the paper roughness (for the surface abutting the carrier) may suitably be in the range of 50-1000 Bekk seconds, suitably 50-150 Bekk seconds, suitably 100 Bekk seconds (measured over an air pressure interval of 50.66-48.00 kPa). (A Bekk smoothness tester is an instrument used to determine the smoothness of a paper surface, in which air at a specified pressure is leaked between a smooth glass surface and a paper sample, and the time (in seconds) for a fixed volume of air to seep between these surfaces is the "Bekk smoothness".)

Conversely, the surface of the support facing away from the aerosol-generating material may be arranged in contact with the heater, and a smoother surface may provide more efficient heat transfer. Thus, in some cases, the support is disposed so as to have a rougher side abutting the aerosol-generating material and a smoother side facing away from the aerosol-generating material.

In one particular case, the support may be a paper-backed foil; the paper layer abuts the aerosol-generating material layer and the properties discussed in the previous paragraphs are afforded by this abutment. The foil backing is substantially impermeable, providing control of the aerosol flow path. A metal foil backing may also serve to conduct heat to the aerosol-generating material.

In another case, the foil layer of the paper-backed foil abuts the aerosol-generating material. The foil is substantially impermeable, thereby preventing water provided in the thermoreversible amorphous solid to be absorbed into the paper which could weaken its structural integrity.

In some cases, the support is formed from or comprises metal foil, such as aluminum foil. A metallic support may allow for better conduction of thermal energy to the thermoreversible amorphous solid. Additionally, or alternatively, a metal foil may function as a susceptor in an induction heating system. In particular embodiments, the support comprises a metal foil layer and a support layer, such as cardboard. In these embodiments, the metal foil layer may have a thickness of less than 20 μm, such as from about 1 μm to about 10 μm, suitably about 5 μm.

In some cases, the support may have a thickness of between about 0.010 mm and about 2.0 mm, suitably from about 0.015 mm, 0.02 mm, 0.05 mm or 0.1 mm to about 1.5 mm, 1.0 mm, or 0.5 mm.

In some cases, the thermoreversible amorphous solid may be formed into a layer or sheet. In such cases, the sheet may have a thickness of about 0.015 mm to about 1.0 mm. Suitably, the thickness may be in the range of about 0.05 mm, 0.1 mm or 0.15 mm to about 0.5 mm or 0.3 mm. The inventors have found that a thermoreversible amorphous solid having a thickness of 0.2 mm is particularly suitable. The thermoreversible amorphous solid may comprise more than one layer, and the thickness described herein refers to the aggregate thickness of those layers.

In some cases, the aerosol-generating material may be formed into a layer or sheet. In such cases, the sheet may have a thickness of about 0.015 mm to about 1.0 mm. Suitably, the thickness may be in the range of about 0.05 mm, 0.1 mm or 0.15 mm to about 0.5 mm or 0.3 mm. The inventors have found that a material having a thickness of 0.2 mm is particularly suitable. The aerosol-generating material may comprise more than one layer, and the thickness described herein refers to the aggregate thickness of those layers.

The inventors have established that if the aerosol-generating material or thermoreversible amorphous solid is too thick, then heating efficiency is compromised. This adversely affects the power consumption in use. Conversely, if the aerosol-generating material or thermoreversible amorphous solid is too thin, it is difficult to manufacture and handle; a very thin material is harder to cast and may be fragile, compromising aerosol formation in use.

The inventors have established that the aerosol-generating material or thermoreversible amorphous solid described herein optimizes the material properties in view of these competing considerations.

The thickness stipulated herein is a mean thickness for the material. In some cases, the thermoreversible amorphous solid thickness may vary by no more than 25%, 20%, 15%, 10%, 5% or 1%. In some cases, the aerosol-generating material thickness may vary by no more than 25%, 20%, 15%, 10%, 5% or 1%.

The aerosol-generating material of these embodiments may be included in an aerosol generating consumable/system as a shredded sheet, optionally blended with cut tobacco. Alternatively, the aerosol-generating material of these embodiments may be included in an aerosol generating consumable/system as a sheet, such as a sheet circumscribing a rod of aerosol-generating material (e.g. tobacco or other botanical material). Alternatively, the aerosol-generating material of these embodiments may be included in an aerosol generating consumable/system as a layer portion disposed on a carrier.

Method of Manufacture

A method of manufacturing an aerosol-generating material is also provided and comprises:

(a) dissolving iota- and/or kappa-carrageenan in water to form an aqueous solution;
(b) supplying a setting agent to the aqueous solution;
(c) adding aerosol-former material, flavorant and/or an active substance to the aqueous solution to form a slurry;
(d) shaping the slurry; and
(e) drying the slurry to form an amorphous solid.

In some embodiments a salt or an acid is added to the aqueous solution of iota- and/or kappa-carrageenan. Suitably, the salt or acid raises the pH of the solution to between pH 7 and pH 9, as measured when the solution is at a temperature of 25° C. In such embodiments, the acid may be included in the thermoreversible amorphous solid in amounts of from about 0.1-5 wt % of acid; for example, 0.1-2 wt % of acid, i.e. 0.1 wt %, 0.5 wt %, 1.0 wt %, 1.5 wt %, 2.0 wt %.

In some embodiments the temperature of the aqueous solution of iota- and/or kappa-carrageenan of a) is raised prior to addition of the setting agent in (b), so that the solution is hot prior to application of the setting agent. Suitably the temperature of said aqueous solution is increased to a temperature between 60-100° C. prior to (b), for example, to a temperature between 60-90° C. or between 70-80° C.

In some cases, when the temperature of the aqueous solution is raised prior to addition of the setting agent of (b), the temperature of the solution is decreased to ambient temperature. Suitably the temperature is decreased to between 20° C.-40° C., for example, to between 20° C.-30° C.

The (d) of shaping the slurry may comprise spraying, casting or extruding the slurry, for example. In some cases, the layer is formed by electrospraying the slurry. In some cases, the layer is formed by casting the slurry.

In some cases, the (b) and/or (c) and/or (d) may, at least partially, occur simultaneously (for example, during electrospraying). In some cases, these events may occur sequentially.

The thermoreversible amorphous solid comprises ingredients in quantities, which are described elsewhere herein;

any features of the thermoreversible amorphous solid described throughout this application apply equally to the method of manufacture.

Non-Combustible Aerosol Provision Systems

Non-combustible aerosol provision systems are also provided. The non-combustible aerosol provision system comprises the consumable described elsewhere herein and a non-combustible aerosol provision device, the non-combustible aerosol provision device comprising an aerosol-generation device to generate aerosol from the substrate of the consumable when the consumable is used with the non-combustible aerosol provision device.

As used herein, the term "delivery system" is intended to encompass systems that deliver a substance to a user, and includes:

combustible aerosol provision systems, such as cigarettes, cigarillos, cigars, and tobacco for pipes or for roll-your-own or make-your-own cigarettes (whether based on tobacco, tobacco derivatives, expanded tobacco, reconstituted tobacco, tobacco substitutes or other smokable material);

non-combustible aerosol provision systems that release compounds from an aerosol-generating material without combusting the aerosol-generating material, such as electronic cigarettes, tobacco heating products, and hybrid systems to generate aerosol using a combination of aerosol-generating materials; consumables comprising aerosol-generating material and configured to be used within one of these non-combustible aerosol provision systems; and aerosol-free delivery systems which deliver one or more substances to a user orally, nasally, transdermally or in another way without forming an aerosol, including but not limited to, lozenges, gums, patches, consumables comprising inhalable powders, and oral products such as oral tobacco which includes snus or moist snuff, wherein the substance may or may not comprise nicotine.

According to the present disclosure, a "combustible" aerosol provision system is one where a constituent aerosol-generating material of the aerosol provision system (or component thereof) is combusted or burned during use in order to facilitate delivery to a user.

According to the present disclosure, a "non-combustible" aerosol provision system is one where a constituent aerosol-generating material of the aerosol provision system (or component thereof) is not combusted or burned in order to facilitate delivery to a user.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is a tobacco heating system, also known as a heat-not-burn system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or amorphous solid and may or may not contain nicotine. In some embodiments, the hybrid system comprises a liquid or amorphous solid and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device. However, it is envisaged that consumables which themselves comprise a means for powering an aerosol generating component may themselves form the non-combustible aerosol provision system.

In some embodiments, the non-combustible aerosol provision device may comprise a power source and a controller. The power source may, for example, be an electric power source or an exothermic power source. In some embodiments, the exothermic power source comprises a carbon substrate which may be energized so as to distribute power in the form of heat to an aerosol-generating material or heat transfer material in proximity to the exothermic power source. In some embodiments, the power source, such as an exothermic power source, is provided in the consumable so as to form the non-combustible aerosol provision.

In some embodiments, the consumable for use with the non-combustible aerosol provision device may comprise an aerosol-generating material, an aerosol generating component, an aerosol generating area, a mouthpiece, and/or an area for receiving aerosol-generating material.

In some embodiments, the aerosol generating component is a heater capable of interacting with the aerosol-generating material so as to release one or more volatiles from the aerosol-generating material to form an aerosol. In some embodiments, the aerosol generating component is capable of generating an aerosol from the aerosol-generating material without heating. For example, the aerosol generating component may be capable of generating an aerosol from the aerosol-generating material without applying heat thereto, for example via one or more of vibrational, mechanical, pressurization or electrostatic means.

In some embodiments, the substance to be delivered may be an aerosol-generating material or a non-aerosol-generating material. As appropriate, either material may comprise an active substance, an aerosol-former material and optionally one or more other functional constituents.

A non-combustible aerosol provision system is also provided and comprises a non-combustible aerosol provision device comprising a power supply and an electrical heater, the electrical heater connected to the power supply; and a substrate cartridge containing an aerosol-generating material in the form of a thermoreversible amorphous solid, the thermoreversible amorphous solid comprising:

0.5-20 wt % iota- and/or kappa-carrageenan;

20-80 wt % aerosol-former material;

20-70 wt % flavorant and/or active substance wherein these weights are calculated on a dry weight basis. The thermoreversible amorphous solid comprises ingredients in quantities, which are described elsewhere herein; any features of the thermoreversible amorphous solid described throughout this application apply equally to the current aspect.

The non-combustible aerosol provision system may comprise a heater configured to heat but not burn the aerosol-generating material. The heater may be, in some cases, an electrically resistive heater such as a thin film electrically resistive heater. In other cases, the heater may comprise an induction heater or the like. In yet further cases, the heater may be a combustible heat source or a chemical heat source which undergoes an exothermic reaction to product heat in use.

In some cases, the heater may heat but not burn the aerosol-generating material(s) to between 120° C. and 350° C. in use. In some cases, the heater may heat but not burn the aerosol-generating material(s) to between 140° C. and 250° C. in use. In some cases in use, substantially all of the aerosol-generating material is less than about 4 mm, 3 mm, 2 mm or 1 mm from the heater. In some cases, the aerosol-generating material is disposed between about 0.017 mm and 2.0 mm from the heater, suitably between about 0.1 mm and 1.0 mm. These minimum distances may, in some cases, reflect the thickness of a carrier that supports the aerosol-generating material. In some cases, a surface of the aerosol-generating material may directly abut the heater.

In some cases, the heater may be embedded in the aerosol-generating material. In some such cases, the heater may be an electrically resistive heater (with exposed contacts for connection to an electrical circuit). In other such cases, the heater may be a susceptor embedded in the aerosol-generating material, which is heated by induction.

The non-combustible aerosol provision system may additionally comprise a cooling element and/or a filter. The cooling element, if present, may act or function to cool gaseous or aerosol components. In some cases, it may act to cool gaseous components such that they condense to form an aerosol. It may also act to space the very hot parts of the apparatus from the user. The filter, if present, may comprise any suitable filter known in the art such as a cellulose acetate plug.

In some cases, the non-combustible aerosol provision system may be a heat-not-burn device. That is, it may contain a solid tobacco-containing material (and no liquid aerosol-generating material). In some cases, the aerosol-generating material may comprise the tobacco material. A heat-not-burn device is disclosed in WO 2015/062983 A2, which is incorporated by reference in its entirety.

In some cases, the non-combustible aerosol provision system may be a hybrid device. That is, it may contain a solid aerosol-generating material and a liquid aerosol-generating material. In some cases, the aerosol-generating material may comprise nicotine. In some cases, the aerosol-generating material may comprise a tobacco material. In some cases, the aerosol-generating material may comprise a tobacco material and a separate nicotine source. The separate aerosol-generating materials may be heated by separate heaters, the same heater or, in one case, a downstream aerosol-generating material may be heated by a hot aerosol which is generated from the upstream aerosol-generating material. A hybrid device is disclosed in WO 2016/135331 A1, which is incorporated by reference in its entirety.

The consumable may alternatively be referred to herein as a cartridge. The consumable may be adapted for use in a THP, a hybrid device or another aerosol generating device. In some cases, the consumable may additionally comprise a filter and/or cooling element, as described previously. In some cases, the consumable may be circumscribed by a wrapping material such as paper.

The consumable may additionally comprise ventilation apertures. These may be provided in the sidewall of the consumable. In some cases, the ventilation apertures may be provided in the filter and/or cooling element. These apertures may allow cool air to be drawn into the consumable during use, which can mix with the heated volatilized components thereby cooling the aerosol.

The ventilation enhances the generation of visible heated volatilized components from the consumable when it is heated in use. The heated volatilized components are made visible by the process of cooling the heated volatilized components such that supersaturation of the heated volatilized components occurs. The heated volatilized components then undergo droplet formation, otherwise known as nucleation, and eventually the size of the aerosol particles of the heated volatilized components increases by further condensation of the heated volatilized components and by coagulation of newly formed droplets from the heated volatilized components.

In some cases, the ratio of the cool air to the sum of the heated volatilized components and the cool air, known as the ventilation ratio, is at least 15%. A ventilation ratio of 15% enables the heated volatilized components to be made visible by the method described above. The visibility of the heated volatilized components enables the user to identify that the volatilized components have been generated and adds to the sensory experience of the smoking experience.

In another example, the ventilation ratio is between 50% and 85% to provide additional cooling to the heated volatilized components. In some cases, the ventilation ratio may be at least 60% or 65%.

Figure 2:
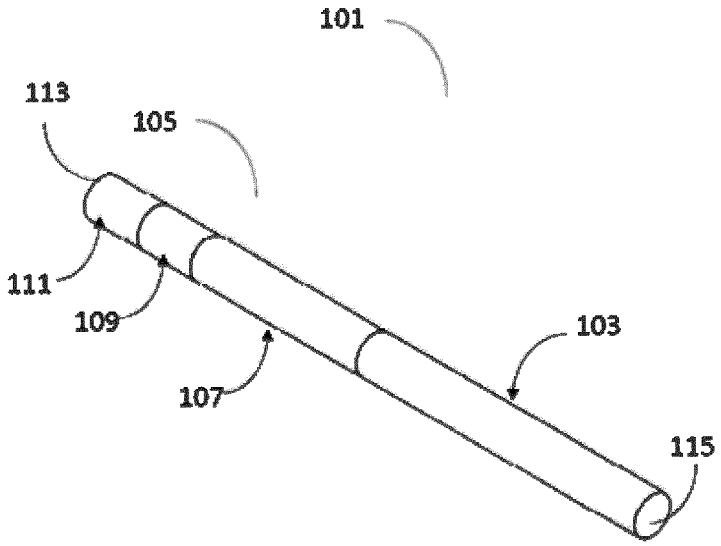
FIG. 2 shows a perspective view of the consumable of FIG. 1.

Referring to FIGS. 1 and 2, there are shown a partially cut-away section view and a perspective view of an example of an aerosol-generating consumable 101. The consumable 101 is adapted for use with a device having a power source and a heater. The consumable 101 of this embodiment is particularly suitable for use with the device 51 shown in FIGS. 5 to 7, described below. In use, the consumable 101 may be removably inserted into the device shown in FIG. 5 at an insertion point 20 of the device 51.

The consumable 101 of one example is in the form of a substantially cylindrical rod that includes a body of aerosol-generating material 103 and a filter assembly 105 in the form of a rod. The aerosol-generating material 103 comprises the thermoreversible amorphous solid material described herein. In some embodiments, it may be included in sheet form. In some embodiments it may be included in the form of a shredded sheet. In some embodiments, the aerosol-generating material 103 described herein may be incorporated in sheet form and in shredded form.

The filter assembly 105 includes three segments, a cooling segment 107, a filter segment 109 and a mouth end segment 111. The consumable 101 has a first end 113, also known as a mouth end or a proximal end and a second end 115, also known as a distal end. The body of aerosol-generating material 103 is located towards the distal end 115 of the consumable 101. In one example, the cooling segment 107 is located adjacent the body of aerosol-generating material 103 between the body of aerosol generating material 103 and the filter segment 109, such that the cooling segment 107 is in an abutting relationship with the aerosol-generating material 103 and the filter segment 109. In other examples, there may be a separation between the body of aerosol-generating material 103 and the cooling segment 107 and between the body of aerosol-generating material 103 and the filter segment 109. The filter segment 109 is located in between the cooling segment 107 and the mouth end segment 111. The mouth end segment 111 is located towards the proximal end 113 of the consumable 101, adjacent the filter segment 109. In one example, the filter segment 109 is in an abutting relationship with the mouth end segment 111. In one embodiment, the total length of the filter assembly 105 is between 37 mm and 45 mm, more preferably, the total length of the filter assembly 105 is 41 mm.

In one example, the rod of aerosol-generating material 103 is between 34 mm and 50 mm in length, suitably between 38 mm and 46 mm in length, suitably 42 mm in length.

In one example, the total length of the consumable 101 is between 71 mm and 95 mm, suitably between 79 mm and 87 mm, suitably 83 mm.

An axial end of the body of aerosol-generating material 103 is visible at the distal end 115 of the consumable 101. However, in other embodiments, the distal end 115 of the consumable 101 may comprise an end member (not shown) covering the axial end of the body of aerosol-generating material 103.

The body of aerosol-generating material 103 is joined to the filter assembly 105 by annular tipping paper (not shown), which is located substantially around the circumference of the filter assembly 105 to surround the filter assembly 105 and extends partially along the length of the body of aerosol-generating material 103. In one example, the tipping paper is made of 58GSM standard tipping base paper. In one example the tipping paper has a length of between 42 mm and 50 mm, suitably of 46 mm.

In one example, the cooling segment 107 is an annular tube and is located around and defines an air gap within the cooling segment. The air gap provides a chamber for heated volatilized components generated from the body of aerosol-generating material 103 to flow. The cooling segment 107 is hollow to provide a chamber for aerosol accumulation yet rigid enough to withstand axial compressive forces and bending moments that might arise during manufacture and whilst the consumable 101 is in use during insertion into the device 51. In one example, the thickness of the wall of the cooling segment 107 is approximately 0.29 mm.

The cooling segment 107 provides a physical displacement between the aerosol-generating material 103 and the filter segment 109. The physical displacement provided by the cooling segment 107 will provide a thermal gradient across the length of the cooling segment 107. In one example the cooling segment 107 is configured to provide a temperature differential of at least 40 degrees Celsius between a heated volatilized component entering a first end of the cooling segment 107 and a heated volatilized component exiting a second end of the cooling segment 107. In one example the cooling segment 107 is configured to provide a temperature differential of at least 60 degrees Celsius between a heated volatilized component entering a first end of the cooling segment 107 and a heated volatilized component exiting a second end of the cooling segment 107. This temperature differential across the length of the cooling element 107 protects the temperature sensitive filter segment 109 from the high temperatures of the aerosol-generating material 103 when it is heated by the device 51. If the physical displacement was not provided between the filter segment 109 and the body of aerosol-generating material 103 and the heating elements of the device 51, then the temperature sensitive filter segment 109 may become damaged in use, so it would not perform its required functions as effectively.

In one example the length of the cooling segment 107 is at least 15 mm. In one example, the length of the cooling segment 107 is between 20 mm and 30 mm, more particularly 23 mm to 27 mm, more particularly 25 mm to 27 mm, suitably 25 mm.

The cooling segment 107 is made of paper, which means that it is comprised of a material that does not generate compounds of concern, for example, toxic compounds when in use adjacent to the heater of the device 51. In one example, the cooling segment 107 is manufactured from a spirally wound paper tube which provides a hollow internal chamber yet maintains mechanical rigidity. Spirally wound paper tubes are able to meet the tight dimensional accuracy requirements of high-speed manufacturing processes with respect to tube length, outer diameter, roundness and straightness.

In another example, the cooling segment 107 is a recess created from stiff plug wrap or tipping paper. The stiff plug wrap or tipping paper is manufactured to have a rigidity that is sufficient to withstand the axial compressive forces and bending moments that might arise during manufacture and whilst the consumable 101 is in use during insertion into the device 51.

The filter segment 109 may be formed of any filter material sufficient to remove one or more volatilized compounds from heated volatilized components from the aerosol-generating material. In one example the filter segment 109 is made of a mono-acetate material, such as cellulose acetate. The filter segment 109 provides cooling and irritation-reduction from the heated volatilized components without depleting the quantity of the heated volatilized components to an unsatisfactory level for a user.

In some embodiments, a capsule (not illustrated) may be provided in filter segment 109. It may be disposed substantially centrally in the filter segment 109, both across the filter segment 109 diameter and along the filter segment 109 length. In other cases, it may be offset in one or more dimensions. The capsule may in some cases, where present, contain a volatile component such as a flavorant or aerosol generating agent.

The density of the material of the filter segment 109 controls the pressure drop across the filter segment 109, which in turn controls the draw resistance of the consumable 101. Therefore, the selection of the material of the filter segment 109 is important in controlling the resistance to draw of the consumable 101. In addition, the filter segment performs a filtration function in the consumable 101.

In one example, the filter segment 109 is made of an 8Y15 grade of filter tow material, which provides a filtration effect on the heated volatilized material, whilst also reducing the size of condensed aerosol droplets which result from the heated volatilized material.

The presence of the filter segment 109 provides an insulating effect by providing further cooling to the heated volatilized components that exit the cooling segment 107. This further cooling effect reduces the contact temperature of the user's lips on the surface of the filter segment 109.

In one example, the filter segment 109 is between 6 mm to 10 mm in length, suitably 8 mm.

The mouth end segment 111 is an annular tube and is located around and defines an air gap within the mouth end segment 111. The air gap provides a chamber for heated volatilized components that flow from the filter segment 109. The mouth end segment 111 is hollow to provide a chamber for aerosol accumulation yet rigid enough to withstand axial compressive forces and bending moments that might arise during manufacture and whilst the consumable is in use during insertion into the device 51. In one example, the thickness of the wall of the mouth end segment 111 is approximately 0.29 mm. In one example, the length of the mouth end segment 111 is between 6 mm to 10 mm, suitably 8 mm.

The mouth end segment 111 may be manufactured from a spirally wound paper tube which provides a hollow internal chamber yet maintains critical mechanical rigidity. Spirally wound paper tubes are able to meet the tight dimensional accuracy requirements of high-speed manufacturing processes with respect to tube length, outer diameter, roundness and straightness.

The mouth end segment 111 provides the function of preventing any liquid condensate that accumulates at the exit of the filter segment 109 from coming into direct contact with a user.

It should be appreciated that, in one example, the mouth end segment 111 and the cooling segment 107 may be formed of a single tube and the filter segment 109 is located within that tube separating the mouth end segment 111 and the cooling segment 107.

Figure 3:
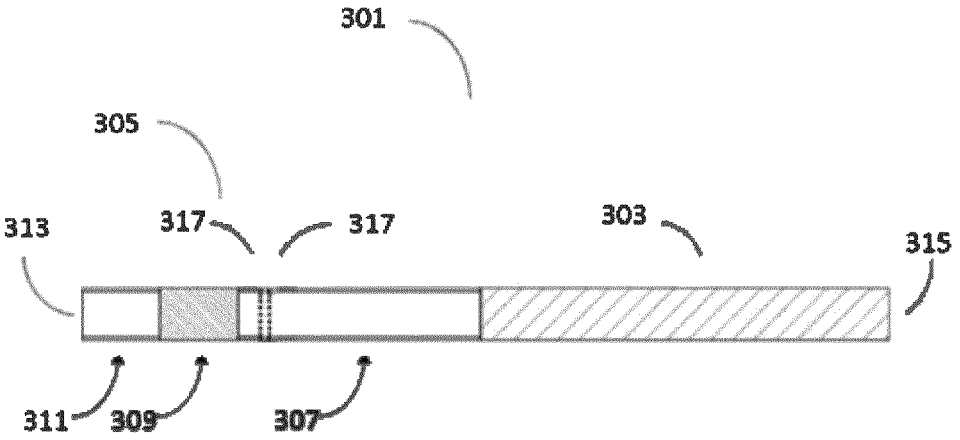
FIG. 3 shows a sectional elevation of an example of a consumable.
Figure 4:
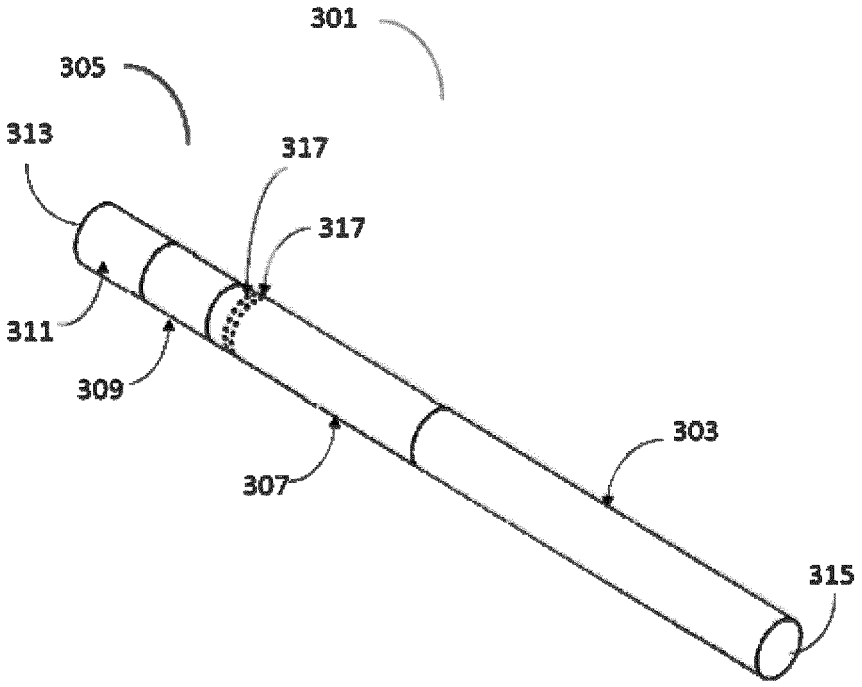
FIG. 4 shows a perspective view of the consumable of FIG. 3.

Referring to FIGS. 3 and 4, there are shown a partially cut-away section and perspective views of an example of a consumable 301. The reference numerals used in FIGS. 3 and 4 correspond to the reference numerals used in FIGS. 1 and 2, incremented by 200.

In the example of the consumable 301 shown in FIGS. 3 and 4, a ventilation region 317 is provided in the consumable 301 to enable air to flow into the interior of the consumable 301 from the exterior of the consumable 301. In one example the ventilation region 317 takes the form of one or more ventilation holes 317 formed through the outer layer of the consumable 301. The ventilation holes may be located in the cooling segment 307 to aid with the cooling of the consumable 301. In one example, the ventilation region 317 comprises one or more rows of holes, and preferably, each row of holes is arranged circumferentially around the consumable 301 in a cross-section that is substantially perpendicular to a longitudinal axis of the consumable 301.

In one example, there are between one to four rows of ventilation holes to provide ventilation for the consumable 301. Each row of ventilation holes may have between 12 to 36 ventilation holes 317. The ventilation holes 317 may, for example, be between 100 μm to 500 μm in diameter. In one example, an axial separation between rows of ventilation holes 317 is between 0.25 mm and 0.75 mm, suitably 0.5 mm.

In one example, the ventilation holes 317 are of uniform size. In another example, the ventilation holes 317 vary in size. The ventilation holes can be made using any suitable technique, for example, one or more of the following techniques: laser technology, mechanical perforation of the cooling segment 307 or pre-perforation of the cooling segment 307 before it is formed into the consumable 301. The ventilation holes 317 are positioned so as to provide effective cooling to the consumable 301.

In one example, the rows of ventilation holes 317 are located at least 11 mm from the proximal end 313 of the consumable, suitably between 17 mm and 20 mm from the proximal end 313 of the consumable 301. The location of the ventilation holes 317 is positioned such that user does not block the ventilation holes 317 when the consumable 301 is in use.

Figure 7:
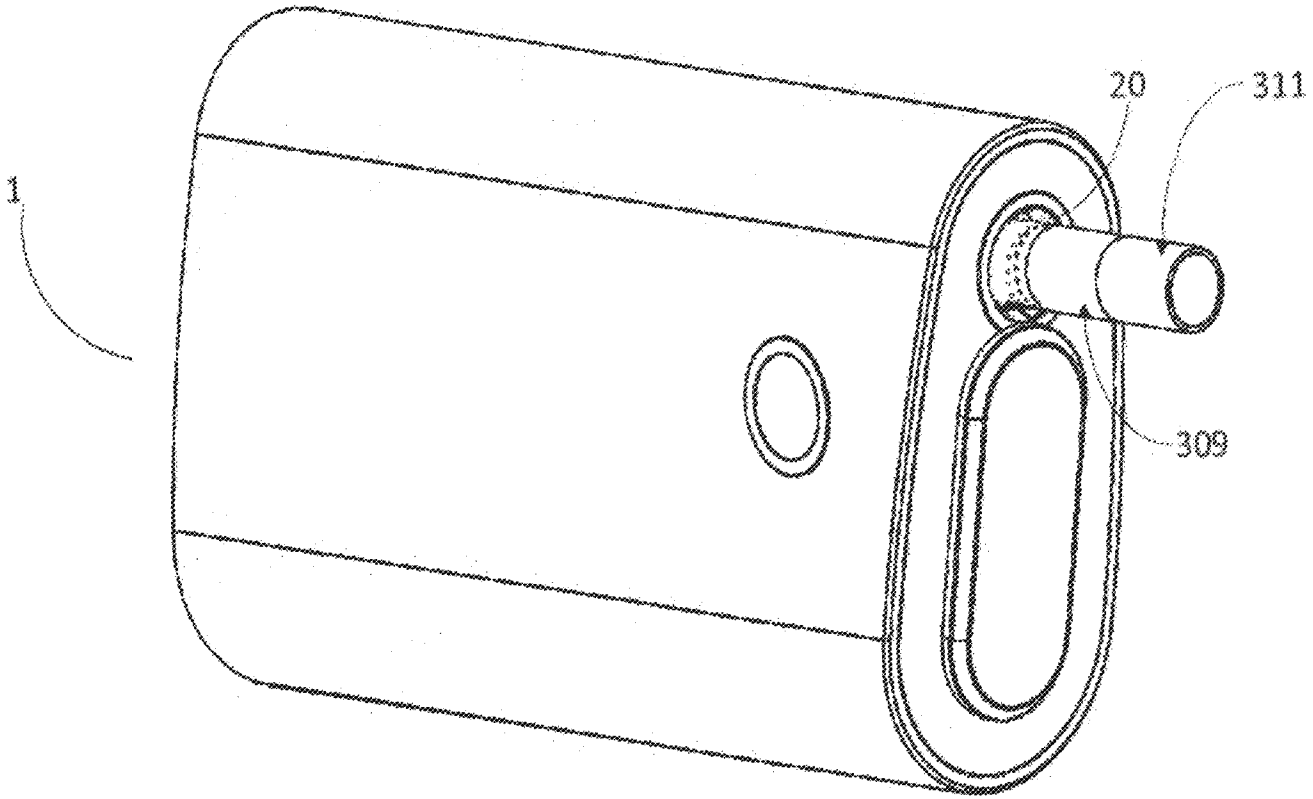
FIG. 7 shows a perspective view of an example of a non-combustible aerosol provision system.

Providing the rows of ventilation holes between 17 mm and 20 mm from the proximal end 313 of the consumable 301 enables the ventilation holes 317 to be located outside of the device 51, when the consumable 301 is fully inserted in the device 51, as can be seen in FIGS. 6 and 7. By locating the ventilation holes outside of the device, non-heated air is able to enter the consumable 301 through the ventilation holes from outside the device 51 to aid with the cooling of the consumable 301.

The length of the cooling segment 307 is such that the cooling segment 307 will be partially inserted into the device 51, when the consumable 301 is fully inserted into the device 51. The length of the cooling segment 307 provides a first function of providing a physical gap between the heater arrangement of the device 51 and the heat sensitive filter arrangement 309, and a second function of enabling the ventilation holes 317 to be located in the cooling segment, whilst also being located outside of the device 51, when the consumable 301 is fully inserted into the device 51. As can be seen from FIGS. 6 and 7, the majority of the cooling element 307 is located within the device 51. However, there is a portion of the cooling element 307 that extends out of the device 51. It is in this portion of the cooling element 307 that extends out of the device 51 in which the ventilation holes 317 are located.

Figure 5:
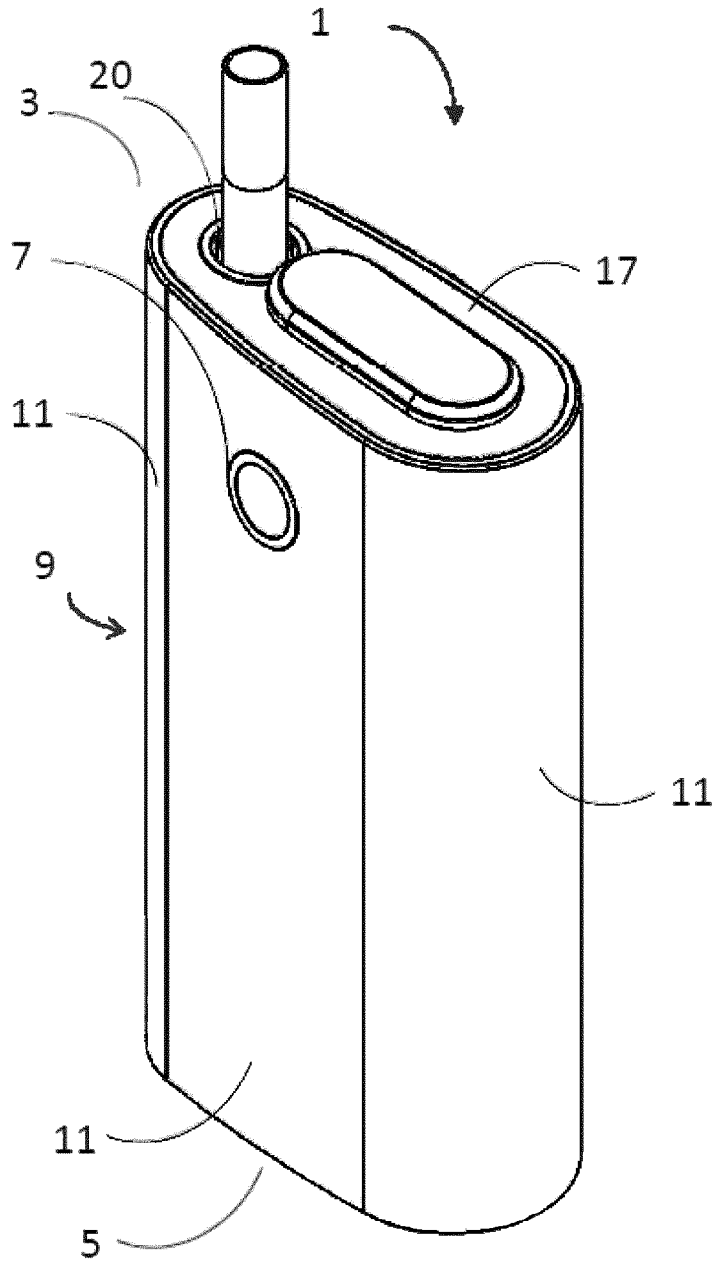
FIG. 5 shows a perspective view of an example of a non-combustible aerosol provision system.
Figure 9:
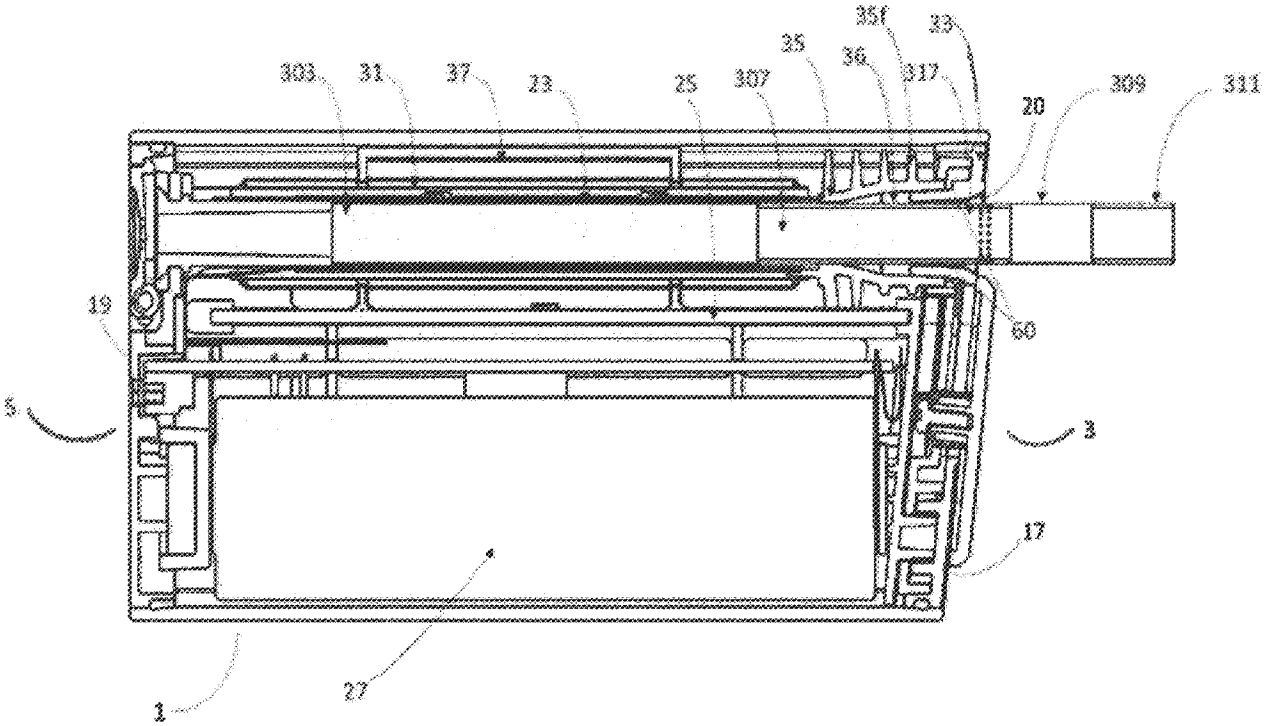

Referring now to FIGS. 5 to 7 in more detail, there is shown an example of a device 51 arranged to heat aerosol-generating material to volatilize at least one component of said aerosol-generating material, typically to form an aerosol which can be inhaled. The device 51 is a heating device which releases compounds by heating, but not burning, the aerosol-generating material.

A first end 53 is sometimes referred to herein as the mouth or proximal end 53 of the device 51 and a second end 55 is sometimes referred to herein as the distal end 55 of the device 51. The device 51 has an on/off button 57 to allow the device 51 as a whole to be switched on and off as desired by a user.

The device 51 comprises a housing 59 for locating and protecting various internal components of the device 51. In the example shown, the housing 59 comprises a uni-body sleeve 11 that encompasses the perimeter of the device 51, capped with a top panel 17 which defines generally the 'top' of the device 51 and a bottom panel 19 which defines generally the 'bottom' of the device 51. In another example the housing comprises a front panel, a rear panel and a pair of opposite side panels in addition to the top panel 17 and the bottom panel 19.

The top panel 17 and/or the bottom panel 19 may be removably fixed to the uni-body sleeve 11, to permit easy access to the interior of the device 51, or may be "permanently" fixed to the uni-body sleeve 11, for example to deter a user from accessing the interior of the device 51. In an example, the panels 17 and 19 are made of a plastics material, including for example glass-filled nylon formed by injection molding, and the uni-body sleeve 11 is made of aluminum, though other materials and other manufacturing processes may be used.

The top panel 17 of the device 51 has an opening 20 at the mouth end 53 of the device 51 through which, in use, the consumable 101, 301 including the aerosol-generating material may be inserted into the device 51 and removed from the device 51 by a user.

The housing 59 has located or fixed therein a heater arrangement 23, control circuitry 25 and a power source 27. In this example, the heater arrangement 23, the control circuitry 25 and the power source 27 are laterally adjacent (that is, adjacent when viewed from an end), with the control circuitry 25 being located generally between the heater arrangement 23 and the power source 27, though other locations are possible.

The control circuitry 25 may include a controller, such as a microprocessor arrangement, configured and arranged to control the heating of the aerosol-generating material in the consumable 101, 301 as discussed further below.

The power source 27 may be for example a battery, which may be a rechargeable battery or a non-rechargeable battery. Examples of suitable batteries include for example a lithium-ion battery, a nickel battery (such as a nickel-cadmium battery), an alkaline battery and/or the like. The battery 27 is electrically coupled to the heater arrangement 23 to supply electrical power when required and under control of the control circuitry 25 to heat the aerosol-generating material in the consumable (as discussed, to volatilize the aerosol-generating material without causing the aerosol-generating material to burn).

An advantage of locating the power source 27 laterally adjacent to the heater arrangement 23 is that a physically large power source 27 may be used without causing the device 51 as a whole to be unduly lengthy. As will be understood, in general a physically large power source 27 has a higher capacity (that is, the total electrical energy that can be supplied, often measured in Amp-hours or the like) and thus the battery life for the device 51 can be longer.

In one example, the heater arrangement 23 is generally in the form of a hollow cylindrical tube, having a hollow interior heating chamber (not shown) into which the consumable 101, 301 comprising the aerosol-generating material is inserted for heating in use. Different arrangements for the heater arrangement 23 are possible. For example, the heater arrangement 23 may comprise a single heating element or may be formed of plural heating elements aligned along the longitudinal axis of the heater arrangement 23. The or each heating element may be annular or tubular, or at least part-annular or part-tubular around its circumference. In an example, the or each heating element may be a thin film heater. In another example, the or each heating element may be made of a ceramics material. Examples of suitable ceramics materials include alumina and aluminum nitride and silicon nitride ceramics, which may be laminated and sintered. Other heating arrangements are possible, including for example inductive heating, infrared heater elements, which heat by emitting infrared radiation, or resistive heating elements formed by for example a resistive electrical winding.

In one particular example, the heater arrangement 23 is supported by a stainless-steel support tube and comprises a polyimide heating element. The heater arrangement 23 is dimensioned so that substantially the whole of the body of aerosol-generating material 103, 303 of the consumable 101, 301 is inserted into the heater arrangement 23 when the consumable 101, 301 is inserted into the device 51.

The or each heating element may be arranged so that selected zones of the aerosol-generating material can be independently heated, for example in turn (over time, as discussed above) or together (simultaneously) as desired.

The heater arrangement 23 in this example is surrounded along at least part of its length by a thermal insulator 31. The thermal insulator 31 helps to reduce heat passing from the heater arrangement 23 to the exterior of the device 51. This helps to keep down the power requirements for the heater arrangement 23 as it reduces heat losses generally. The thermal insulator 31 also helps to keep the exterior of the device 51 cool during operation of the heater arrangement 23. In one example, the thermal insulator 31 may be a double-walled sleeve which provides a low pressure region between the two walls of the sleeve. That is, the thermal insulator 31 may be for example a "vacuum" tube, i.e. a tube that has been at least partially evacuated so as to minimize heat transfer by conduction and/or convection. Other arrangements for the thermal insulator 31 are possible, including using heat insulating materials, including for example a suitable foam-type material, in addition to or instead of a double-walled sleeve.

The housing 59 may further comprises various internal support structures 37 for supporting all internal components, as well as the heating arrangement 23.

The device 51 further comprises a collar 33 which extends around and projects from the opening 20 into the interior of the housing 59 and a generally tubular chamber 35 which is located between the collar 33 and one end of the thermal insulator 31. The chamber 35 further comprises a cooling structure **35*f*, which in this example, comprises a plurality of cooling fins 35*f* spaced apart along the outer surface of the chamber 35, and each arranged circumferentially around outer surface of the chamber 35. There is an air gap 36 between the hollow chamber 35 and the consumable 101, 301 when it is inserted in the device 51 over at least part of the length of the hollow chamber 35. The air gap 36 is around all of the circumference of the consumable 101, 301 over at least part of the cooling segment 307**.

The collar 33 comprises a plurality of ridges 60 arranged circumferentially around the periphery of the opening 20 and which project into the opening 20. The ridges 60 take up space within the opening 20 such that the open span of the opening 20 at the locations of the ridges 60 is less than the open span of the opening 20 at the locations without the ridges 60. The ridges 60 are configured to engage with a consumable 101, 301 inserted into the device to assist in securing it within the device 51. Open spaces (not shown) defined by adjacent pairs of ridges 60 and the consumable 101, 301 form ventilation paths around the exterior of the consumable 101, 301. These ventilation paths allow hot vapors that have escaped from the consumable 101, 301 to exit the device 51 and allow cooling air to flow into the device 51 around the consumable 101, 301 in the air gap 36.

In operation, the consumable 101, 301 is removably inserted into an opening 20 of the device 51, as shown in FIGS. 5 to 7. Referring particularly to FIG. 6, in one example, the body of aerosol-generating material 103, 303, which is located towards the distal end 115, 315 of the consumable 101, 301, is entirely received within the heater arrangement 23 of the device 51. The proximal end 113, 313 of the consumable 101, 301 extends from the device 51 and acts as a mouthpiece assembly for a user.

In operation, the heater arrangement 23 will heat the consumable 101, 301 to volatilize at least one component of the aerosol-generating material from the body of aerosol-generating material 103, 303.

The primary flow path for the heated volatilized components from the body of aerosol-generating material 103, 303 is axially through the consumable 101, 301, through the chamber inside the cooling segment 107, 307, through the filter segment 109, 309, through the mouth end segment 111, 311 to the user. In one example, the temperature of the heated volatilized components that are generated from the body of aerosol generating material is between 60° C. and 250° C., which may be above the acceptable inhalation temperature for a user. As the heated volatilized component travels through the cooling segment 107, 307, it will cool and some volatilized components will condense on the inner surface of the cooling segment 107, 307.

In the examples of the consumable 301 shown in FIGS. 3 and 4, cool air will be able to enter the cooling segment 307 via the ventilation holes 317 formed in the cooling segment 307. This cool air will mix with the heated volatilized components to provide additional cooling to the heated volatilized components.

EXAMPLE

Example 1

Kappa-carrageenan (0.27 g) was hydrated in 21.6 g water. Locust bean gum (0.06 g) was added to the solution on a hot plate and the aqueous solution was heated to 80° C.

The aqueous solution was then allowed to return to ambient temperature and 0.075 g calcium lactate was added.

8 g of the following formulation was added:

| Component | Wt % |
|---|---|
| Glycerol | 41.00 |
| Nicotine | 5.00 |
| Benzoic acid | 2.00 |
| Flavor | 48.00 |

The final composition of the thermoreversible amorphous solid formed by these steps was:

| Ingredient | Wt % |
|---|---|
| Kappa - carrageenan | 4% |
| Locust bean gum | 4% |
| Filler | 0% |
| Calcium | 1% |
| Flavorant/Tobacco extract | 48% |
| Glycerol | 41% |
| Nicotine | 5% |
| Acid | 2% |
| | 100% |

DEFINITIONS

Active Substance

In some embodiments, the substance to be delivered comprises an active substance.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, cannabis or another botanical.

In some embodiments, the active substance comprises nicotine. In some embodiments, the active substance comprises caffeine, melatonin or vitamin B12.

In some embodiments, the active substance comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT).

The active substance may comprise one or more cannabinoid compounds selected from the group consisting of cannabidiol (CBD) and THC (tetrahydrocannabinol).

The active substance may comprise cannabidiol (CBD).

The active substance may comprise nicotine and cannabidiol (CBD).

The active substance may comprise nicotine, cannabidiol (CBD), and THC (tetrahydrocannabinol).

Botanicals

As noted herein, the active substance may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca*, *Mentha piperita*, *Mentha piperita* citrata c.v., *Mentha piperita* c.v, *Mentha spicata crispa*, *Mentha cardifolia*, *Memtha longifolia*, *Mentha suaveolens variegata*, *Mentha pulegium*, *Mentha spicata* c.v. and *Mentha suaveolens*

In some embodiments, the active substance comprises or is derived from one or more botanicals or constituents, derivatives or extracts thereof and the botanical is tobacco.

In some embodiments, the active substance comprises or derived from one or more botanicals or constituents, derivatives or extracts thereof and the botanical is selected from eucalyptus, star anise, cocoa and hemp.

In some embodiments, the active substance comprises or derived from one or more botanicals or constituents, derivatives or extracts thereof and the botanical is selected from rooibos and fennel.

Flavors

In some embodiments, the substance to be delivered comprises a flavor.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some embodiments, the flavor may comprise a sensate, which is intended to achieve a somatosensorial sensation which is usually chemically induced and perceived by the stimulation of the fifth cranial nerve (trigeminal nerve), in addition to or in place of aroma or taste nerves. Sensates may include agents providing heating, cooling, tingling, numbing effect. A suitable heat effect agent may be, but is not limited to, vanillyl ethyl ether and a suitable cooling agent may be, but not limited to eucolyptol, WS-3.

Aerosol-Generating Material

Aerosol-generating material is a material that is capable of generating aerosol, for example when heated, irradiated or energized in any other way. Aerosol-generating material may, for example, be in the form of a solid, liquid or gel which may or may not contain an active substance and/or flavorants. In some embodiments, the aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about 50 wt %, 60 wt % or 70 wt % of amorphous solid, to about 90 wt %, 95 wt % or 100 wt % of amorphous solid.

The aerosol-generating material may comprise one or more active substances and/or flavors, one or more aerosol-former materials, and optionally one or more other functional material.

Aerosol-Former Material

The aerosol-former material may comprise one or more constituents capable of forming an aerosol. In some embodiments, the aerosol-former material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

In some embodiments, the aerosol-former material comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

Functional Material

The one or more other functional materials may comprise one or more of pH regulators, coloring agents, preservatives, binders, fillers, stabilizers, and/or antioxidants.

Substrate

The aerosol-generating material may be present on or in a support, and in some such cases may be referred to as a 'substrate'. The support may, for example, be or comprise paper, card, paperboard, cardboard, reconstituted material, a plastics material, a ceramic material, a composite material, glass, a metal, or a metal alloy. In some embodiments, the support comprises a susceptor. In some embodiments, the susceptor is embedded within the material. In some alternative embodiments, the susceptor is on one or either side of the material.

Consumable

A consumable is an article comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor.

Susceptor

A susceptor is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein.

Aerosol Generator

An aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy.

All percentages by weight described herein (denoted wt %) are calculated on a dry weight basis, unless explicitly stated otherwise. All weight ratios are also calculated on a dry weight basis. A weight quoted on a dry weight basis refers to the whole of the extract or slurry or material, other than the water, and may include components which by themselves are liquid at room temperature and pressure, such as glycerol. Conversely, a weight percentage quoted on a wet weight basis refers to all components, including water.

For the avoidance of doubt, where in this specification the term "comprises" is used, embodiments are also contemplated in which the feature can be defined using the terms "consists essentially of" or "consists of" in place of "comprises". Reference to a material "comprising" certain features means that those features are included in, contained in, or held within the material.

The above embodiments are to be understood as illustrative examples. Further embodiments are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A substrate comprising an aerosol-generating material, the aerosol-generating material comprising a thermoreversible amorphous solid, the thermoreversible amorphous solid comprising:

4.0-20 wt % of iota-and/or kappa-carrageenan;

20-80 wt % of an aerosol-former material;

30-70 wt % of a flavorant and/or an active substance;

wherein these weights are calculated on a dry weight basis.

2. The substrate according to claim 1, wherein the thermoreversible amorphous solid comprises kappa-carrageenan.

3. The substrate according to claim 1, wherein the thermoreversible amorphous solid further comprises a source of calcium.

4. The substrate according to claim 3, wherein the source of calcium is calcium lactate or calcium formate.

5. The substrate according to claim 1, wherein the thermoreversible amorphous solid is solid at a temperature less than about 30° C.

6. The substrate according to claim 1, wherein the thermoreversible amorphous solid is liquid at a temperature greater than about 30° C.

7. The substrate according to claim 1, wherein the thermoreversible amorphous solid comprises 0.5-10 wt % of the carrageenan.

8. The substrate according to claim 1, wherein the thermoreversible amorphous solid comprises 35-50 wt % of the aerosol-former material.

9. The substrate according to claim 1, wherein the thermoreversible amorphous solid comprises an acid.

10. The substrate according to claim 9, wherein the acid is benzoic acid.

11. The substrate according to claim 9, wherein the thermoreversible amorphous solid comprises 0.1-5 wt % of the acid.

12. The substrate according to claim 11, wherein the thermoreversible amorphous solid comprises 0.1-2 wt % of the acid.

13. The substrate according to claim 1, wherein the thermoreversible amorphous solid comprises a filler selected from one or more of: woodpulp, cellulose and cellulose derivatives.

14. The substrate according to claim 1, wherein the amount of any flavourant present in the thermoreversible amorphous solid is 30-70 wt %.

15. A non-combustible aerosol provision system comprising a consumable and a non-combustible aerosol provision device, the consumable comprising a substrate, the substrate comprising an aerosol-generating material, the aerosol-generating material comprising a thermoreversible amorphous solid, the thermoreversible amorphous solid comprising:

4.0-20 wt % of iota-and/or kappa-carrageenan;

20-80 wt % of an aerosol-former material;and 30-70 wt % of a flavorant and/or an active substance;

wherein these weights are calculated on a dry weight basis.

16. The system according to claim 15, wherein the non-combustible aerosol provision device is a heat-not-burn device.

17. The system according to claim 15, wherein the non-combustible aerosol provision device is a hybrid device or a vaping device.

18. A method of manufacturing an aerosol-generating material, the aerosol-generating material comprising a thermoreversible amorphous solid, the thermoreversible amorphous solid comprising:

4.0-20 wt % of iota-and/or kappa-carrageenan;

20-80 wt % of an aerosol-former material;

30-70 wt % of a flavorant and/or an active substance;

wherein these weights are calculated on a dry weight basis;

the method comprising:

(a) dissolving iota-and/or kappa-carrageenan in water to form an aqueous solution;

(b) supplying a setting agent to the aqueous solution;

(c) adding aerosol-former material, and a flavorant and/or an active substance to the aqueous solution to form a slurry;

(d) shaping the slurry; and (e) drying the slurry to form an amorphous solid.

19. The method of manufacturing according to claim 18, wherein a salt or an acid is added to the aqueous solution at (a).

20. The method of manufacturing according to claim 19, wherein the acid is added in an amount such that the amorphous solid comprises 0.1-5 wt % of the acid.

21. The method of manufacturing according to claim 18, wherein a temperature of the aqueous solution is raised to between 60° C. and 100° C. prior to the supplying of the setting agent.

* * * * *